US005175947A

United States Patent [19]

Parracho

[11] Patent Number: 5,175,947

[45] Date of Patent: Jan. 5, 1993

[54] SHOE WITH REMOVABLE ANKLE SUPPORT

[75] Inventor: Rui Parracho, Peabody, Mass.

[73] Assignee: Converse Inc., North Reading, Mass.

[21] Appl. No.: 863,354

[22] Filed: Mar. 31, 1992

Related U.S. Application Data

[63] Continuation of Ser. No. 642,186, Jan. 16, 1991, abandoned.

[51] Int. Cl.[5] ..... A43B 7/20

[52] U.S. Cl. ..... 36/89; 36/88; 36/132

[58] Field of Search ..... 36/89, 90, 88, 136, 36/72 B, 72 R, 132, 114, 73; 128/166, 80 H

[56] References Cited

U.S. PATENT DOCUMENTS

| | | | |
|---|---|---|---|
| 459,616 | 9/1891 | Von Rohonezy | 36/89 |
| 1,155,506 | 10/1915 | Osaki | 36/89 |
| 1,546,551 | 7/1925 | Petri | 36/89 |
| 3,408,754 | 11/1968 | Kueter | 36/2.5 |
| 4,649,939 | 3/1987 | Curtis | 128/80 H |
| 4,936,295 | 1/1990 | Crane | 128/80 H |
| 4,972,613 | 11/1990 | Loueder | 36/114 |

FOREIGN PATENT DOCUMENTS

| | | | |
|---|---|---|---|
| 3004668 | 8/1981 | Fed. Rep. of Germany | 36/117 |

*Primary Examiner*—Paul T. Sewell
*Assistant Examiner*—Thomas P. Hilliard
*Attorney, Agent, or Firm*—Bromberg & Sunstein

[57] ABSTRACT

A shoe includes a removable structure, having lateral and medial sheet springs. Each spring has a Y shape and is removably attached, with a rotary-keyed fastener, to the side of the shoe below the ankle. The springs are fastened under tension to each other around the ankle so as to inhibit displacement of the ankle.

7 Claims, 5 Drawing Sheets

SHOE WITH REMOVABLE ANKLE SUPPORT

This is a continuation of copending application Ser. No. 07/642,186 filed on Jan. 16, 1991, now abandoned.

TECHNICAL FIELD

The invention relates generally to shoes, and more specifically to athletic shoes of the type provided with ankle support.

BACKGROUND OF THE INVENTION

The prior art includes several devices for providing ankle support for shoes. U.S. Pat. No. 4,766,681, assigned to the assignee herein and hereby incorporated herein by reference, discloses an athletic shoe having a Y-shaped spring on each side of the ankle embedded in the side of the shoe wherein an arm of the Y-shaped spring on one side of the ankle fastens under tension to an arm of the Y-shaped spring on the other side of the ankle.

The prior art includes several removable support devices for shoes. U.S. Pat. No. 1,155,506 to Osaki discloses a removable support for a shoe having a strap that surrounds the ankle.

None of these patents disclose a structure that provides an ankle support that includes sheet springs and is removable. None of these patents provide the advantages of the present invention.

SUMMARY OF THE INVENTION

A shoe in accordance with the present invention includes a removable structure, having lateral and medial sheet springs. Each spring has a top portion and a bottom portion. The bottom portion of the lateral spring is removably attached to a point on the lateral side of the shoe below the ankle. The bottom portion of the medial spring is removably attached to a point on the medial side of the shoe below the ankle. A point on the top portion of the lateral spring is fastened under tension to a point on the top portion of the medial spring so as to inhibit displacement of the ankle. In a preferred embodiment, the springs have a Y-shape and are removeably attached to the shoe with rotary-keyed fasteners, and are attached to each other around the rear of the ankle using a strap.

DESCRIPTION OF SPECIFIC EMBODIMENTS

Figure 1:
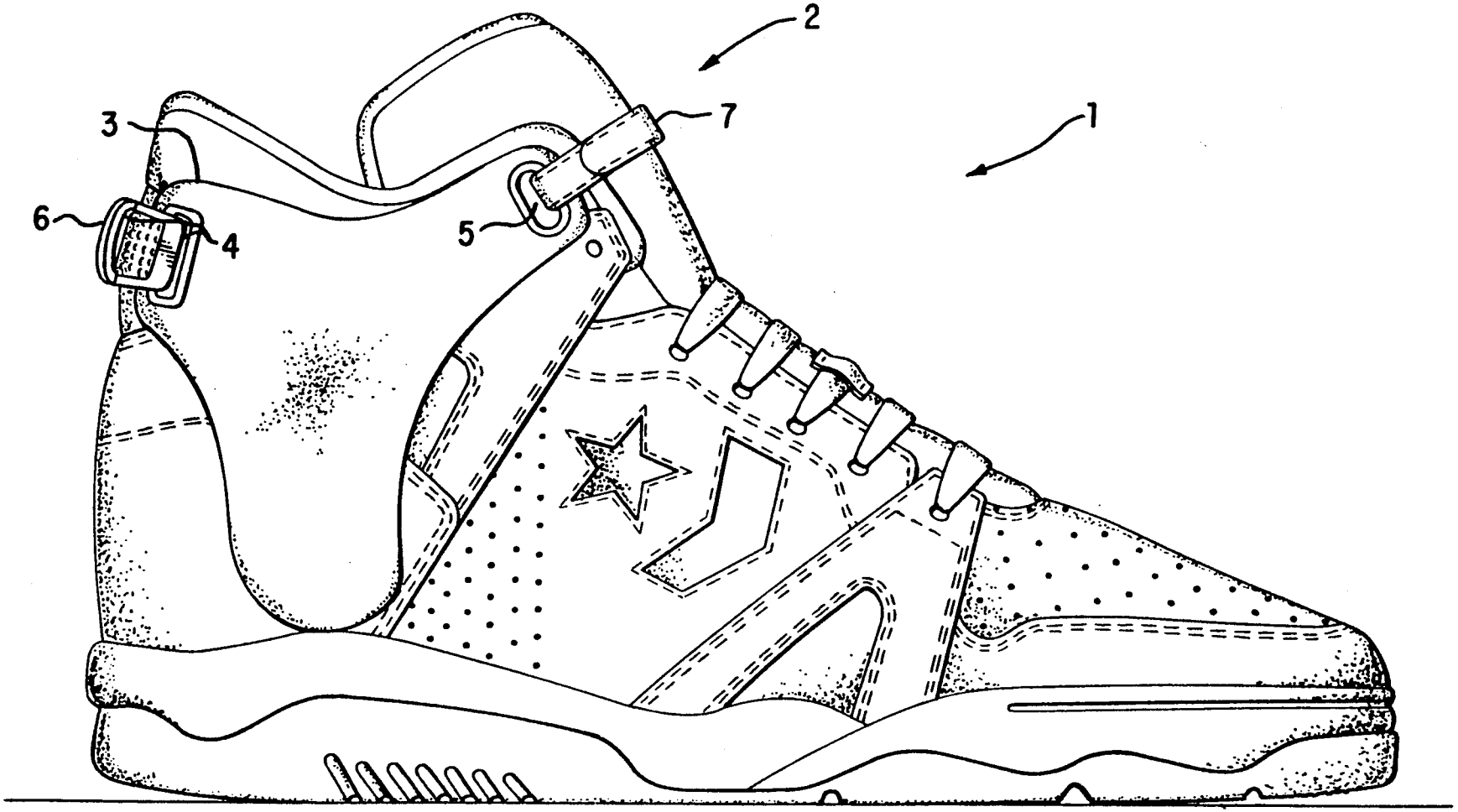
FIG. 1 is a side view of a first embodiment of a shoe according to the present invention.

FIG. 1 shows a first embodiment of a shoe (1) according to the present invention with the ankle support (2) attached to the shoe. The ankle support of this embodiment comprises a pair of sheet springs (3), one on the lateral side of the shoe, one on the medial side of the shoe. Each sheet spring has a Y shape, having a lower vertical portion, an upper rear portion, and an upper fore portion. A rotary-keyed fastener attached to the inner face of the lower vertical portion of each sheet spring allows the sheet spring to be removably attached to the side of the shoe below the level of the ankle. This fastener is not visible when the ankle support is attached to the shoe: it is hidden by the sheet spring. In the upper rear portion of each sheet spring is a slot (4) for a rear strap and in the upper fore portion is a slot (5) for a fore strap. Rear strap (6) passes through the rear strap slot in each sheet spring and provides adjustable tension around the back of the ankle. Fore strap (7) passes through the fore slot in each sheet spring and provides adjustable tension above the foot forward of the ankle. In the embodiment of FIG. 1, both straps are provided with hook and loop fasteners.

Figure 2:
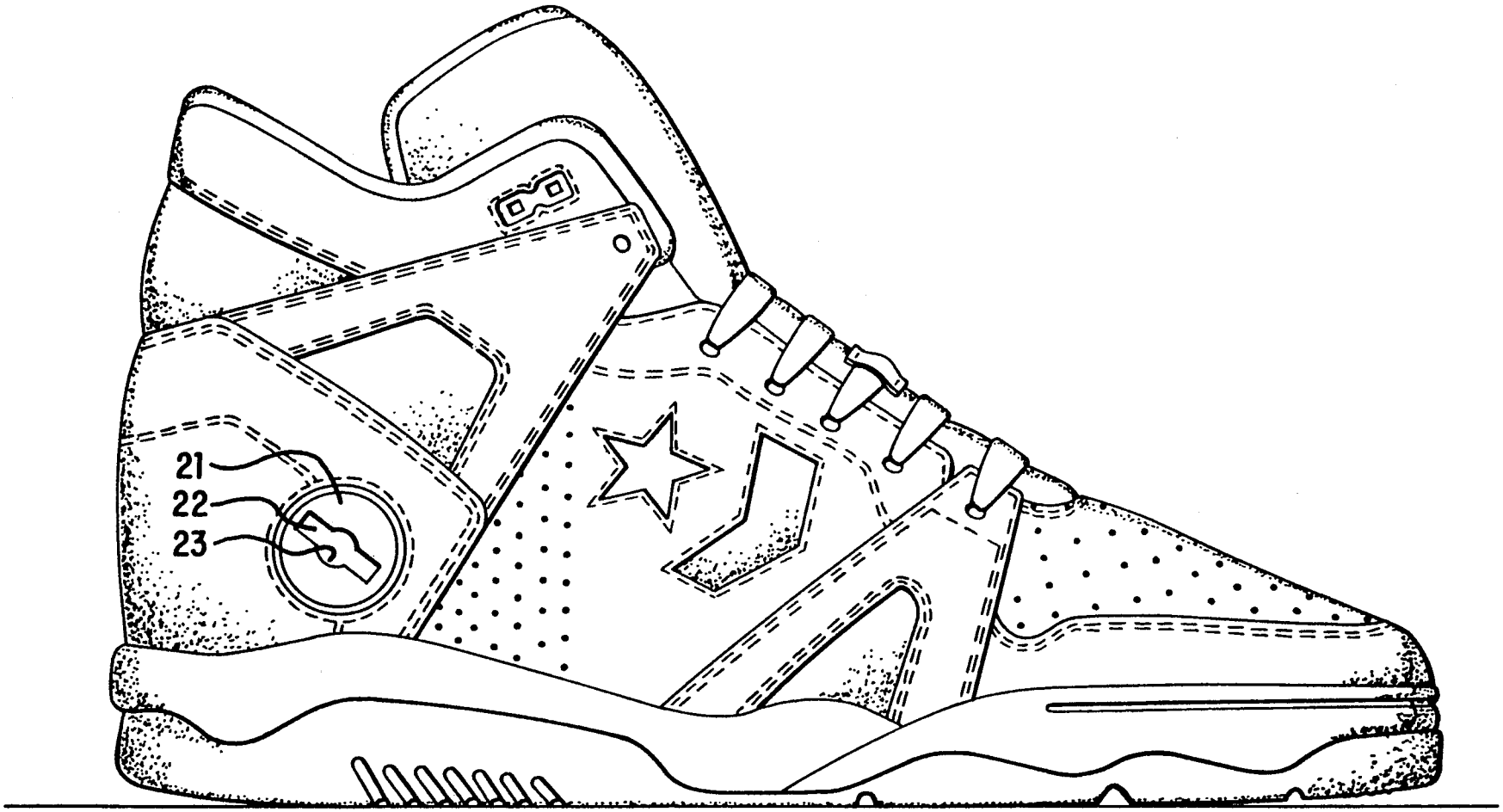
FIG. 2 is a side view of the embodiment of FIG. 1 with the removable ankle support removed.

FIG. 2 shows the embodiment of FIG. 1 with the removable ankle support removed from the shoe to reveal the female portion (21) of the rotary-keyed fastener mentioned above. This portion of the fastener has a slot (22) and a centering cut-away (23).

Figure 3A:
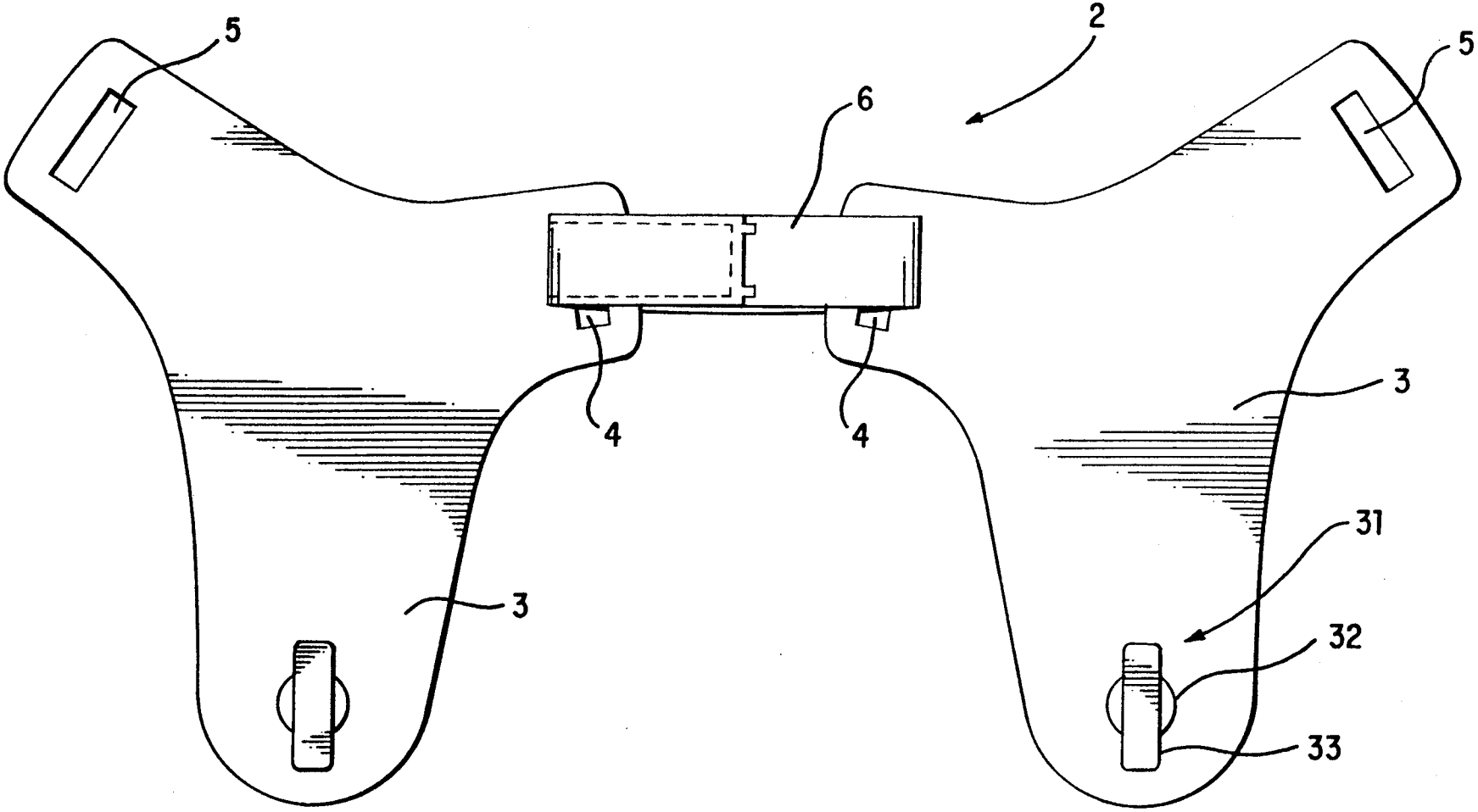
FIG. 3A is a view of the inner side of the removable ankle support, showing an adjustable strap.

FIG. 3A shows an elevation view of the inner side of the removable ankle support (2) revealing the male portion of the rotary-keyed fastener (31). The male portion of the fastener has a centering post (32) and a retaining bar (33).

Figure 4:
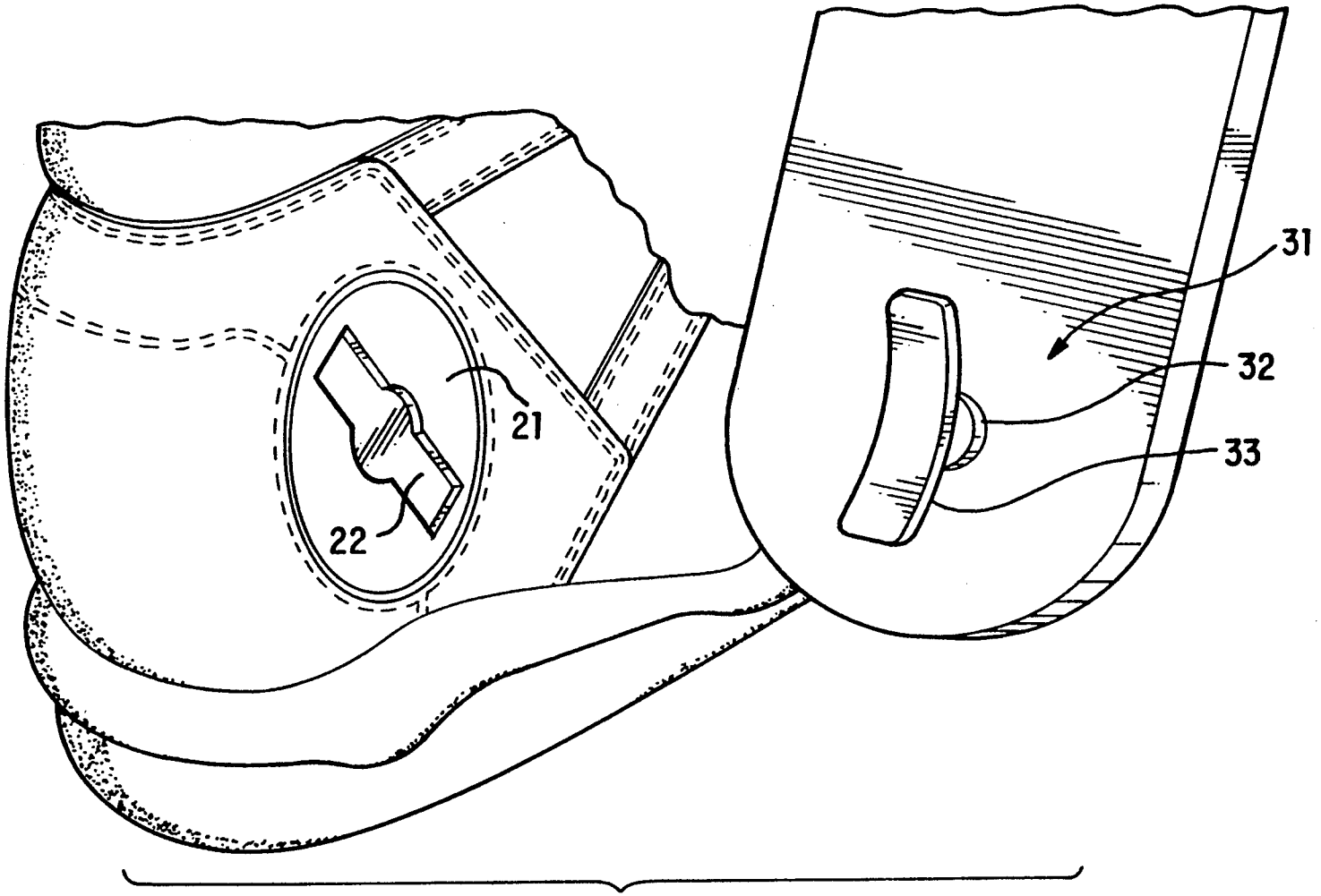
FIG. 4 is a perspective view of the keyed fastener.

FIG. 4 provides a perspective view of both portions of the keyed fastener. The fastener is attached by aligning retaining bar (33) with slot (22), inserting the bar into the slot and turning the bar about the axis of the post (32). The use of such a fastener allows the fore strap and rear strap to hold the fastener in its keyed (i.e., locked-in-place) position easily, without any kind of adjustment. The orientation of the bar and slot, as shown in FIG. 2 and FIG. 4, when the fore strap is releases, allows the removal of the sheet springs after they are rotated rearward by a little less than 90° from their normal position. Conversely, when the sheet springs are held in their normal position by the fore strap and the rear strap, the keyed fastener is held in a locked condition.

The sheet springs are formed of a sheet spring material which may, for instance, be spring steel but is preferably a plastic material, such as a nylon-type polymer, which is resistant to both bending and twisting out of its plane, and is relatively unstretchable and incompressible in such plane.

Figure 3B:
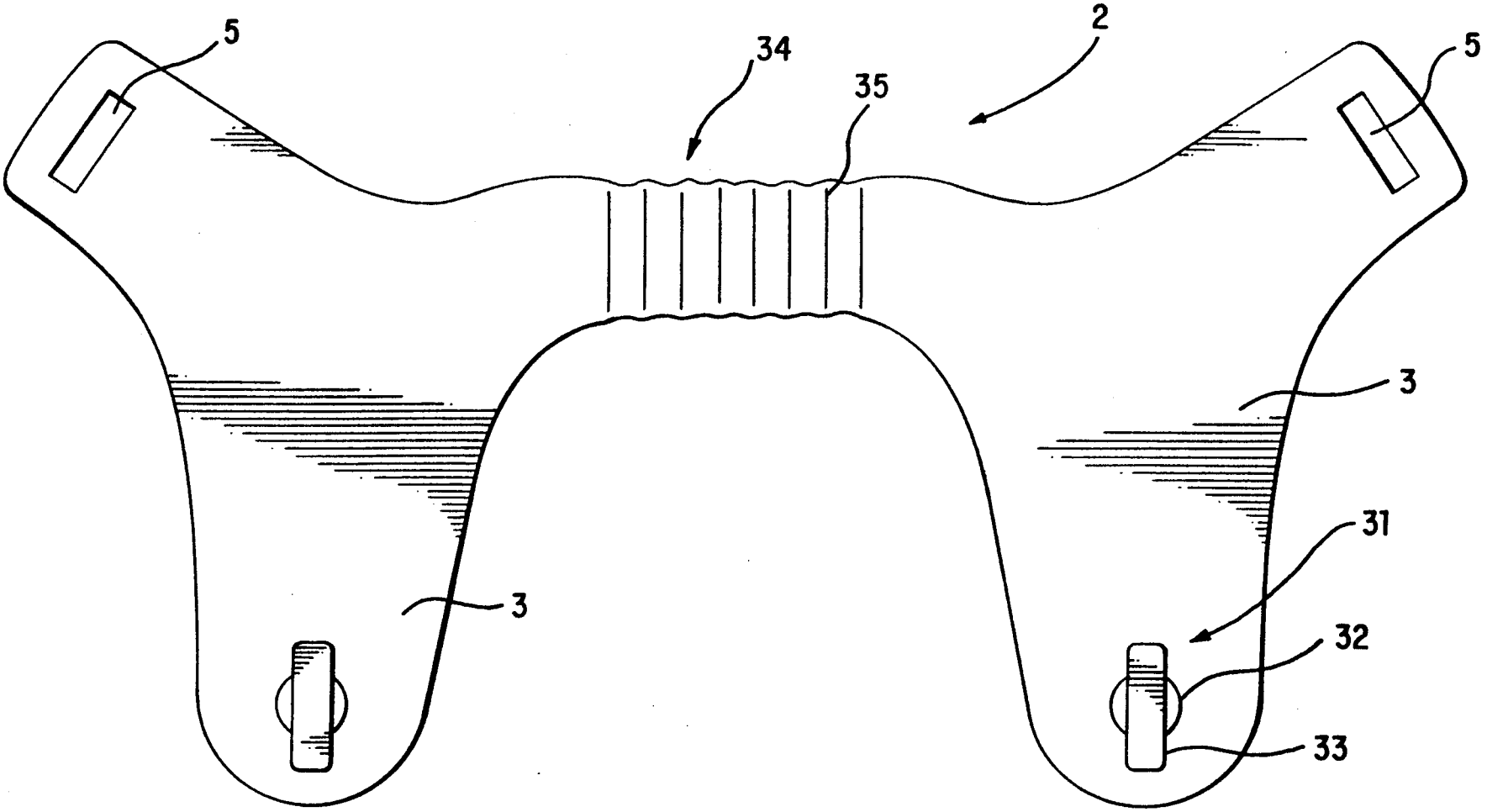
FIG. 3B is a view of the inner side of a second embodiment of the removable ankle support, showing integral construction.

The sheet springs, which are shown in FIG. 3A as two separate pieces, may be fabricated as a one-piece wrap-around single member. In this case the wrap-around connecting portion, joining the upper rear portions of the two sheet springs, would preferably be of bellows or corrugated or other flexible construction. FIG. 3B shows an elevation view of the inner side of the removable ankle support having integral construction. The strap (34) is made of the same material as the springs and is provided with corrugations (35) to add flexibility. In this embodiment all tension adjustment of the band surrounding the ankle is provided by the strap that passes around the front of the ankle.

The sheet springs, in the embodiment of FIG. 1, are attached directly to the shoe at only a single point below the ankle on each side of the shoe. This construction allows the ankle support to be used with low-cut shoes as well as with high-cut shoes such as shown in FIG. 1. Removal of the ankle support, when a rotary-keyed fastener is used, is accomplished by unfastening strap (7) and rotating the ankle support backward and downward about an axis passing through the center of the two fasteners. Alternatively, many other types of fasteners may be used, such as a screw fastener, a snap-action fastener or various kinds of keyed fasteners. For example, a sliding keyed fastener may be used. In this case the ankle support would slide downward to release. In the embodiment using the rotary-keyed fastener (shown in FIG. 2) and in the embodiment using the sliding keyed fastener (herein above described), the fastener is held in a keyed position by strap (7). In embodiments using an alternative type of fastener, an additional locking device could be provided. In the case of a screw fastener, a locking nut could be provided.

It should be noted that each of the embodiments shown in FIG. 1–4 provides an ankle support having fastener devices that are concealed when the ankle support is attached and that preserves an agreeable appearance of the shoe when the ankle support is removed.

What is claimed is:

1. An improved athletic shoe of the type having an outsole, a midsole and an upper, wherein the upper is formed with a lateral side sheet portion and a medical side sheet portion, each side sheet portion having a bottom edge and a top edge, each side sheet portion being attached along its bottom edge to the outsole, and fastening means for fastening the top edge of the lateral side sheet portion to the top edge of the medial side sheet portion, wherein the improvement comprises:

a removable structure, having a lateral sheet spring and a medial sheet spring, each spring made of a material which is resistant to both bending and twisting out of its plane and is relatively unstretchable and incompressible in such plane, each spring having a bottom portion and a top portion, the lateral spring having an inner side facing the lateral side sheet portion, the medial spring having an inner side facing the medial side sheet portion, and having forward attachment means for fastening under tension a point on the top portion of the lateral spring to a point on the top portion of the medial spring;

lateral attachment means having a first part and a second part, the first part associated with the inner side of the bottom portion of the lateral spring, the second part associated with the lateral side sheet portion, for removably attaching the lateral spring directly to the lateral sheet portion below the region of the ankle and above the region of the sole; and medial attachment means having a first part and a second part, the first part associated with the inner side of the bottom portion of the medial spring, the second part associated with the medial side sheet portion, for removably attaching the medial spring directly to the medial sheet portion below the region of the ankle and above the region of the sole;

wherein the first part of the lateral attachment means includes a lateral retaining bar mounted on a lateral centering post, the lateral centering post being fixedly attached to the inner side of the lateral spring, and the first part of the medial attachment means includes a medial retaining bar mounted on a medial centering post, the medial centering post being fixedly attached to the inner side of the medial spring;

wherein the second part of the lateral attachment means includes a lateral side sheet portion having a slot, such slot hereinafter referred to as a "lateral slot", sized to accept the lateral retaining bar, and the second part of the medial attachment means includes a medial side sheet portion having a slot, such slot hereinafter referred to as a "medial slot", sized to accept the medial retaining bar;

whereby the structure, when attached to the shoe, may inhibit displacement of the ankle.

2. An athletic shoe according to claim 1, wherein the removable structure is configured such that it may be attached to the shoe by a method comprising:

(a) aligning the lateral retaining bar with the lateral slot and the medial retaining bar with the medial slot;

(b) inserting the lateral retaining bar into the lateral slot and the medial retaining bar into the medial slot;

(c) locking the lateral bar into the lateral slot and the medial bar into the medial slot by rotating the removable structure about a line passing through the two slots.

3. An athletic shoe according to claim 2, wherein the lateral and medial sheet springs are of unitary construction;

such that the removable structure further includes a band portion, made of the same material as the springs, that may pass behind the ankle.

4. An athletic shoe according to claim 2, wherein each spring has a Y-shape and the top portion of each spring includes a fore arm portion and rear arm portion.

5. An athletic shoe according to claim 4, further including cushioning means, extending upward from the region of the arms, and extending around the rear of the shoe to form a collar above the removable structure, for protecting the leg from contact with the removable structure.

6. An athletic shoe according to claim 4, further including rear attachment means for fastening under tension the ends of the rear arm portions.

7. An athletic shoe according to claim 6, wherein the rear attachment means is a strap.

* * * * *